US006294069B1

(12) United States Patent
Durandetti et al.

(10) Patent No.: US 6,294,069 B1
(45) Date of Patent: Sep. 25, 2001

(54) METHOD FOR PREPARING 2-ARYL OR 2-HETEROCYCLYL CHIRAL PROPIONIC ACIDS AND THEIR ESTERS

(75) Inventors: Muriel Durandetti, Fresnes; Isabelle Lachaise, Rungis; Jean-Yves Nedelec, L'Hay-les-Roses; Jacques Perichon, Savigny sur Orge, all of (FR)

(73) Assignee: Centre National de la Recherche Scientifique (FR)

( * ) Notice: Subject to any disclaimer, the term of this patent is extended or adjusted under 35 U.S.C. 154(b) by 0 days.

(21) Appl. No.: 09/446,496

(22) PCT Filed: Jun. 24, 1998

(86) PCT No.: PCT/FR98/01336

§ 371 Date: Jan. 27, 2000

§ 102(e) Date: Jan. 27, 2000

(87) PCT Pub. No.: WO99/00535

PCT Pub. Date: Jan. 7, 1999

(30) Foreign Application Priority Data

Jun. 25, 1997 (FR) ..... 97 07908

(51) Int. Cl.[7] ..... C25B 3/10; C25B 3/00; C25B 3/08

(52) U.S. Cl. ..... 205/422; 205/423; 205/424; 205/425; 205/426; 205/427; 205/431; 205/435; 205/436; 205/440; 205/441; 205/443; 205/444; 205/445; 205/455; 205/459; 205/460

(58) Field of Search ..... 205/422–427, 205/431, 435, 436, 440, 441, 443–445, 455, 459, 460

(56) References Cited

U.S. PATENT DOCUMENTS 5,013,412 * 5/1991 Conan et al. ..... 204/59 R

FOREIGN PATENT DOCUMENTS

2646441-A1 * 11/1990 (FR) .

* cited by examiner

*Primary Examiner*—Edna Wong
(74) *Attorney, Agent, or Firm*—Bierman, Muserlian and Lucas

(57) ABSTRACT

A process for the preparation of chiral 2-aryl or 2-heterocyclyl-propionic acids of the formula

II

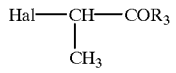

wherein the substituents are as defined in the specification.

36 Claims, No Drawings

METHOD FOR PREPARING 2-ARYL OR 2-HETEROCYCLYL CHIRAL PROPIONIC ACIDS AND THEIR ESTERS

This application is a 371 of PCT/FR98/01336 filed Jun. 24, 1998.

This invention relates to a method for preparing very highly enantiomerically pure chiral 2-aryl or 2-heterocyclyl propionic acids (R or S) and their esters.

2-Aryl and 2-heterocyclyl propionic acids and their esters are useful as antiinflammatory drugs (for example ketoprofen, ibuprofen, naproxen, tiaprofen, fenoprofen, flurbiprofen, indoprofen, pirprofen, suprofen, cicloprofen, carprofen, benoxaprofen, hexaprofen, pranaprofen) and also as intermediates for the preparation of drugs (for example EP514442, EP516729, EP518961, EP518960, EP520016, EP593639, EP527069, EP607355, EP538099, EP678098, EP679161, EP678088, EP678089, EP766695, EP766696).

The 2-aryl and 2-heterocyclyl propionic acids and their esters are used either in their racemic form or in the form of an enantiomer (R or S), In general, the biological activity of these compounds is associated with a single enantiomer and it is thus necessary to obtain these enantiomers by a simple, inexpensive and non-polluting industrial method.

Many methods of preparation of these compounds have been developed but they generally lead to racemic compounds and the enantiomers must then be separated by chemical resolution or microbial conversion.

The 2-aryl and 2-heterocyclyl propionic acids and their esters are preferably represented by the formula:

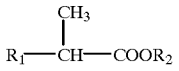

(I)

in which $R_1$ represents an optionally substituted aryl or heterocyclic group and $R_2$ represents a hydrogen atom or an alkyl or phenylalkyl radical.

More particularly, $R_1$ is (a) a phenyl radical, (b) a phenyl radical substituted by one or more substituents selected from chlorine, bromine. fluorine, alkyl, alkoxy, alkenyl, hydroxy, hydroxyalkyl, acyl, benzoyl, amino, phenyl, chlorophenyl, bromophenyl, fluorophenyl, phenoxy, cyano, polyfluoroalkyl, polyfluoroalkoxy, alkoxycarbonyl, —CH($NH_2$)—COOH, saturated or unsaturated heterocycle with 5 to 14 members and containing a heteroatom selected from nitrogen, oxygen or sulfur optionally substituted by chlorine, bromine, fluorine, alkyl, phenyl, chlorophenyl, bromophenyl, fluorophenyl, (c) a naphthyl radical, (d) a naphthyl radical substituted by one or more substituents selected from chlorine, bromine, fluorine, alkyl, alkoxy, alkenyl, hydroxy, hydroxyalkyl, acyl, benzoyl, amino, phenyl, chlorophenyl, bromophenyl, fluorophenyl, phenoxy, cyano, polyfluoroalkyl, polyfluoroalkoxy, alkoxycarbonyl, saturated or unsaturated heterocycle with 5 to 14 members and containing one or more heteroatoms selected from nitrogen, oxygen or sulfur optionally substituted by chlorine, bromine, fluorine, alkyl, phenyl, chlorophenyl, bromophenyl, fluorophenyl. (e) a 9H-fluorenyl radical, (f) an anthracenyl radical, (g) a phenanthrenyl radical, (h) a saturated or unsaturated heterocycle with 5 to 14 members and containing one or more heteroatoms selected from nitrogen, oxygen or sulfur, (i) a saturated or unsaturated heterocycle with 5 to 14 members and containing one or more heteroatoms selected from nitrogen, oxygen or sulfur and substituted by one or more substituents selected from chlorine, bromine, fluorine, alkyl, alkoxy, acyl, benzoyl, amino, phenyl, chlorophenyl, bromophenyl, fluorophenyl, phenoxy, cyano, polyfluoroalkyl, polyfluoroalkoxy, alkoxycarbonyl, saturated or unsaturated heterocycle with 5 to 14 members and containing one or more heteroatoms selected from nitrogen, oxygen or sulfur optionally substituted by chlorine, bromine, fluorine, alkyl, phenyl, chlorophenyl, bromophenyl, fluorophenyl.

The 5 to 14-membered heterocycles may include carbazole, indan, thiophene, furan, 1-isoindolinone, pyrrole, 2,5-dihydropyrrole, benzoxazole, 5H[1]benzopyrano[2,3-b] pyridine, pyridine, imidazole, oxazole, quinoline, isoquinoline, pyrimidine, phenothiazine, phenoxazine, piperazine.

More particularly, $R_1$ represents a 3 benzoylphenyl, 2-aminophenyl, 3-aminophenyl, 4-aminophenyl, 4-isobutylphenyl, 6-methoxy-2-naphthyl, 5-benzoyl-2-thienyl, 3-phenoxyphenyl, 2-fluoro-4-biphenyl, 3-fluoro-4-biphenyl, 1-oxo- 2-isoindolinyl, 3-chloro-4-(2,5-dihydro-1H-pyrrol-1-yl)phenyl, 4-(2-thienylcarbonyl)phenyl, 9H-fluoren-2-yl, 6-chloro-9H-carbazol-3-yl, 2-(4-chlorophenyl)benzoxazol-5-yl, 4-cyclohexylphenyl, pyridin-2-yl, 5H[1]benzopyrano[2,3-b]pyridin-7-yl, 3-trifluoromethoxyphenyl, 3-acetylphenyl radical.

More particularly, $R_2$ represents a hydrogen atom or a methyl, ethyl, propyl, isopropyl, butyl, tert-butyl or benzyl radical.

Except where stated otherwise, in the definitions given above or below, the alkyl, alkoxy and alkenyl radicals contain 1 to 6 carbon atoms in straight or branched chains, the acyl radicals contain 2 to 6 carbon atoms and the halogen atoms are chlorine, bromine, iodine and fluorine atoms.

It is known that the electrochemical reduction of a mixture of the methyl ester of chiral 2-chloropropionic acid and iodobenzene, in the presence of nickel catalyst, does not load to the desired chiral product but to the racemic ester (M. DURANDETTI et al., J. Org. Chem., 61, 1748–1755 (1996)).

It has now been unexpectedly found that it is possible to prepare the chiral 2-aryl or 2-heterocyclyl propionic acids and their esters with a very good enantiomeric excess by electrochemical reduction of a mixture of a propionic acid derivative with formula

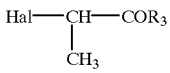

II in which $R_3$ represents a radical of formula:

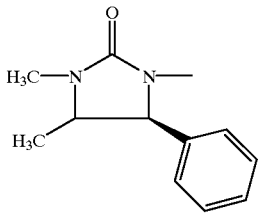

A or

-continued

B

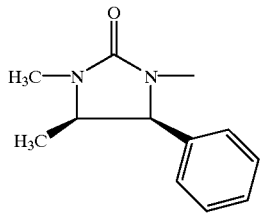

or

C

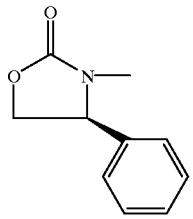

and Hal represents a halogen atom, preferably a chlorine atom, or $R_3$ is an aromatic or heterocyclic halogen derivative in which the halogen is preferably an iodine, bromine or chlorine atom, in the presence of a nickel complex as catalyst and a supporting electrolyte in an electrolysis cell provided with electrodes in organic solvent medium, then either by hydrolysis to obtain the chiral 2-aryl or 2-heterocyclyl propionic acid or by transesterification to obtain the corresponding ester.

The derivatives of formula (II) for which $R_3$ represents an A or C residue load to 2-aryl or 2-heterocyclyl propionic acids (R) and the derivatives of formula (II) for which $R_3$ represents a B residue lead to 2-aryl or 2-heterocyclyl propionic acids (S).

The aromatic or heterocyclic halogen derivatives are preferably of formula:

$$R_1\text{-Hal} \qquad \text{(III)}$$

in which $R_1$ has the same values as in formula (I) and Hal represents an iodine, chlorine or bromine atom.

The derivatives (II) and the aromatic or heterocyclic halogen derivatives are reacted together in stoichiometric amounts. It is preferable to add the derivative (II) progressively during the electrolysis.

The nickel complex is preferably a complex with a nitrogen-containing ligand and more particularly a $NiBr_2$bipyridine or nickel-orthophenanthroline complex. It may be prepared either extemporaneously or in situ before the start of the electrolysis.

The quantity of the nickel complex is generally between 0.01 mole and 0.2 mole for 1 mole of the aromatic or heterocyclic halogen derivative and preferably 0.1 mole for 1 mole of the aromatic or heterocyclic halogen derivative.

The electrolyte is generally a quaternary ammonium salt such as tetrabutylammonium tetrafluoroborate or tetrabutylammonium bromide or an inorganic salt such as sodium bromide. Its concentration is generally between $5\times10^{-3}$ M and $2\times10^{-3}$ M and preferably $1.5\times10^{-2}$ M.

The solvent is generally an aprotic solvent such as dimethylformamide, N-methylpyrrolidone (preferably dimethylformamide) or a mixture of aprotic and protic solvents, preferably a dimethylformamide-ethanol mixture (80–20% to 20–80%).

The anode is a consumable anode of aluminium or an aluminium alloy such as Duralumin or a zinc, iron or magnesium anode. It is preferable to use an aluminium anode.

The nature of the cathode is not critical for this type of reaction. It may be composed of another conducting material resistant to the conditions of the experiment, such as stainless steel (especially in sintered form), copper, nickel or a carbon fibre fabric. It is preferably composed of a nickel foam grid with a high specific surface area. According to a preferred embodiment of the method, the cathode has a hollow cylindrical shape and is arranged concentrically around the anode.

The temperature of the medium is generally maintained at an optimal value, which depends on the nature of the aromatic or heterocyclic halogen derivative used, by immersing the reactor in a thermoregulated bath or by a double-jacket system. It is generally between 15° C. and 100° C., preferably at about 20° C.

The electrolysis is carried out at constant intensity at a value of between 0.1 and 1 Ampere according to the surface area of the cathode used. The current density is preferably from 0.5 to 1 A/dm$^2$ with respect to the cathode surface area.

The quantity of electricity necessary is determined by the disappearance of the aromatic or heterocyclic halogen derivative followed by an appropriate analytical method (for example by gas-phase chromatography). It is generally between 2 and 3 Faradays per mole of aromatic or heterocyclic halogen derivative, and preferably 2.5 Faradays per mole of aromatic or heterocyclic halogen derivative.

According to an embodiment of the method according to the invention, the electrolytic reduction is carried out in an electrolyser without a separate compartment containing the solvent in which is dissolved

- the base electrolyte,
- the aromatic or heterocyclic halogen derivative at a concentration of between 0.01 M/l and 1 M/l (preferably 0.25 M/l),
- the nickel catalyst (preferably 10% in moles with respect to the initial aromatic or heterocyclic halogen derivative),
- the derivative (II) (preferably 3% in moles with respect to the initial aromatic or heterocyclic halogen derivative).

The remainder of the derivative (II) is generally added in small portions during the electrolysis by any suitable means (in solid or liquid form or in solution in one of the solvents forming the medium).

The electrolyser comprises:

- a consumable anode,
- a cathode,
- a stirring system,
- an inlet for inert gas (for example argon or nitrogen) in order to protect the solution from the oxygen in the air during the electrolysis. It is advantageous to deaerate the solution by bubbling the inert gas for 10 minutes before the start of the electrolysis.,
- a temperature regulation system,
- a stabilized electrical supply.

According to an embodiment, the reaction is carried out in a tubular circulating electrolyser comprising a central aluminium or Duralumin bar as anode and a stainless steel tube as cathode. The two electrodes are insulated by Teflon® gaskets which also ensure watertightness. The cathode may be lined on the inside by a cylindrical nickel foam grid so as to increase the active surface area.

The movement solution is initialed by a pump. It penetrates into the reactor by a lateral tube located towards its lower end and leaves by a similar tube located towards the upper end. A thermostatted expansion vessel is included in tho reaction medium circuit.

The electrical intensity in regulated so that the electrical density is similar to that used in the other type of reactor.

The hydrolysis of the product obtained after extraction, to obtain the propionic acid, is carried out in acid or alkaline medium. It is preferably carried out either by 6N aqueous sulfuric acid under reflux or by the action of lithium hydroxide, in an inert solvent such as tetrahydrofuran, at a temperature of about 20° C.

The transesterification to obtain the alkyl or phenylalkyl ester is generally carried out by the action of potassium carbonate and an aliphatic alcohol (straight or branched chain of 1 to 6 carbon atoms) or an alcohol Ar-alkOH in which Ar represents a phenyl radical and alk represents an alkyl radical, at a temperature of about 20° C.

The derivatives of formula (II) may be obtained by condensation of 2-chloropropionic acid chloride with the lithium salt of (4S, 5R)-1,5-dimethyl-4-phenylimidazolidin-2-one, of (4R5S)-1,5-dimethyl-4-phenylimidazolidin-2-one or of (4R)-4-phenyloxazolidin-2-one.

The aromatic or heterocyclic halogen derivatives are commercially available or may be obtained by application or adaptation of the methods described in J. Prakt Chem., 109, 318 (1925); Gazz. Chim. Ital., 122 (12). 511–514 (1992); Tetrahedron, 50 (4). 1243–1260 (1994), J. Org. Chem., 32, 2692–2895 (1967), J. Org. Chem., 13, 916 (1948), Chem. Abst. 6878 (1955); Recueil Trav. Chim Pays-Bas. 427 507 51923; Recueil Trav. Chim. Pays-Bas, 1, 285 (1952); J. Amer. Chem. Soc., 76, 1106 (1954); J. Chem. Soc., 653–656 (1934); Recueil Trav. Chim. Pay-Bas, 69, 1083–1101 (1950): Eur. J. Mod. Chem. Chim. Ther, 23, 477–482 (1988): Chem. Abst., 59, 2752; Monatsh. Chem., 126 (5). 569–578 (1995); J. Amer. Chem. Soc., 75, 745 (1953); J. Org. Chem., 25, 1590–1595 (1960); J. Org. Chem., 25, 1194–1198 (1960); Gazz. Chim. Ital., 122 (12), 511–514 (1992); Synlett, (4). 353–355 (1996): Organometallics, 10 (4), 1183–9 (1991); Chem. Abst., 100: 174586 and 124: 175743; Monatsch. Chem., 91, 319–330 (1960); Chem. Abst., 106: 196047; J. Amer. Chem. Soc., 59, 2699 (1937); J. Amer. Chem. Soc., 75, 1115 (1953); Recueil Trav. Chim. Pays-Bas, 68, 5 (1949); J. Chem. Soc., Perkin Trans II, 1232–1235 (1978); J. Amer. Chem. Soc., 75, 1115 (1953): Gazz. Chim. Ital., 25 II. 361 (1895); Chem. Abst., 99: 70710; Chem. Abst, 106: 152883; Chem. Abst., 105: 61017: C. R. Hebd. Seances Acad. Sci., 207, 676 (1938), 213, 655 (1941), 205, 991 (1937), 215, 578 (1942); Bull. Soc. Chim. Fr., 38, 726 (1939), 11, 127 (1944) and 10, 198 (1943); C. R. Acad, Sci., 207, 676 (1938) and 213, 655 (1941); J. Amer. Chem. Soc., 62, 1550 (1940); J. Chem. Soc. Perkin Trans II 559 (1976): J. Chem. Soc., 503 (1929); Chem. Abst., 83: 131564, 119: 249672: Chem. Pharm. Bull., 12 (10), 1135–1138 (1964); Chem. Abst., 85: 123755; 99: 70710; 88: 62380 and the patents U.S. Pat. Nos. 5,254,776, 4,107,169, JR88-68627, FR2471962, ES510415, U.S. Pat. No. 4,107,169.

The following examples illustrate the invention.

EXAMPLE A

Preparation of the NickelBr$_2$Bipyridine Catalyst in Situ in Aprotic Medium

In 40 ml of dimethylformamide are added 0.27 grams of hydrated nickel bromide with stirring until dissolution. 0.15 grams of 2,2'-bipyridine are then added in small portions. The stirring is maintained overnight at ambient temperature (about 20° C.) A deep green solution (A) is obtained containing $10^{-3}$ mole of catalyst.

EXAMPLE B

Preparation of the NickelBr$_2$Bipyridine Catalyst in Situ in Protic Medium

In 32 ml of absolute ethanol are added 0.27 grams of hydrated nickel bromide with stirring until dissolution. 0.15 grams of 2,2'-bipyridine are then added in small portions. The stirring is maintained overnight at ambient temperature (about 20° C.). A deep green precipitate of the catalyst is obtained the nickel-bipyridine complex. After warming, 8 ml of dimethylformamide are added and stirred until dissolution of the precipitate. A solution (B) is thus obtained containing $10^{-3}$ mole of catalyst.

EXAMPLE C

Preparation of the Derivative of Formula (II) for Which $R_3$ is a Residue and Hal is a Chlorine Atom 50 g of (–)-ephedrine (0.248 mole) are mixed with 45 g of urea (0.75 mole). The mixture is heated for a half-hour at 170° C. then for one hour at 200° C. After cooling, 150 ml of water are added to the white oily mass. The white precipitate thus obtained is filtered, rinsed with 5% HCl, then rinsed with water. The white precipitate is recrystallized from 40 ml of methanol; this gives 17.6 g of (4S, 5R)-1,5-dimethyl-4-phenylimidazolidin-2-one, i.e. 37%. The filtrate is evaporated then the precipitate is recrystallized from 10 ml of methanol, giving 6.2 g of (4S, 5R)-1,5-dimethyl-4-phenylimidazolidin-2-one, i.e. 13%. The total yield in (4S, 5R)-1,5-dimethyl-4-phenylimidazolidin-2-one is thus 50%.

0.05 Mole of (4S, 5R)-1,5-dimethyl-4-phenylimidazolidin-2-one in 50 ml of freshly distilled tetrahydrofuran are introduced. The solution is cooled to −78° C. using a bath of ethyl acetate-dry ice, then 35 ml of 1.6M butyllithium in hexane (1.12 equivalents) are rapidly added drop by drop using a degassed dropping funnel under argon flow. The mixture is left to react for one hour with stirring at −78° C., then 6 ml of 2-chloropropionic acid chloride (1.25 equivalents) are added drop by drop. The reaction with the acid chloride is instantaneous. The solution is hydrolysed with 30 ml of water and the temperature raised to about 20° C. The mixture is extracted with 3×20 ml of ethyl acetate. The product is separated on a silica column, using a pentane-ether mixture (50/50) as eluent. The yield is 75%.

EXAMPLE D

Preparation of the Derivative of Formula (II) for which $R_3$ is A B Residue and Hal is Chlorine Atom 50 g of (+)-ephedrine (0.248 mole) are mixed with 45 g of urea (0.75 mole). The mixture is heated for a half-hour at 170° C. then for one hour at 200° C. After cooling, 150 ml of water are added to the white oily mass. The white precipitate thus obtained is filtered, rinsed with 5% HCl, then rinsed with water. The white precipitate is recrystallized from 40 ml of methanol; this gives 17.6 g of (4R, 5S)-1,5-dimethyl-4-phenylimidazolidin-2-one, i.e. 37%. The filtrate is evaporated, then the precipitate is recrystallized from 10 ml of methanol, giving 6.2 g of (4R, 5S)-1,5-dimethyl-4-phenylimidazolidin-2-one, i.e. 13%. The total yield in (4R, 5S)-1,5-dimethyl-4-phenylimidazolidin-2-one is thus 50%.

0.05 Mole of (4R, 5S)-1,5-dimethyl-4-phenylimidazolidin-2-one in 50 ml of freshly distilled tetrahydrofuran are introduced. Tho solution is cooled to −78° C. using a bath of ethyl acetate-dry ice, then 35 ml of 1.6M butyllithium in hexane (1.12 equivalents) are rapidly added drop by drop using a degassed dropping funnel under argon flow. The mixture is left to react for one hour with stirring at −78° C., then 6 ml of 2-chloropropionic acid chloride (1.25 equivalents) are added drop by drop. The reaction with the acid chloride is instantaneous. The solution is hydrolysed with 30 ml of water and the temperature raised to about 20° C. The mixture is extracted with 3×20 ml of ethyl acetate. The product is separated on a silica column, using a pentane-ether mixture (50/50) as eluent. The yield is 75%.

EXAMPLE E

Preparation of the Derivative of formula (II) for which $R_3$ is A C Residue and Hal is a Chlorine Atom 0.05 Mole of (R)(−)-2-amino-2-phenylethanol are mixed with 0.15 mole of urea. The mixture is heated for a half-hour at 170° C. then for one hour at 200° C. After cooling, 150 ml of water are added to the white oily mass. A white precipitate is obtained which is dissolved in 100 ml of ether and the solution is filtered. The filtrate contains pure (4R)-4-phenyloxazolidin-2-one. The white residue collected on the filter is taken up with 50 ml of ethyl acetate. This is filtered and a 2nd fraction of pure (4R)-4-phenyloxazolidin-2-one is recovered in the filtrate. The total yield in (4R)-4-phenyloxazolidin-2-one from the two tractions collected is 65%.

0.05 Mole of (4R)-4-phenyloxazolidin-2-one in 50 ml of freshly distilled tetrahydrofuran are introduced. The solution is cooled to −78° C. using a bath of ethyl acetate-dry ice, then 35 ml of 1.6M butyllithium in hexane (1.12 equivalents) are rapidly added drop by drop using a dropping funnel under argon flow. The mixture is left to react for one hour with stirring at −78° C., then 6 ml of 2-chloropropionic acid chloride (1.25 equivalents) are added drop by drop. The reaction with the acid chloride is instantaneous. The solution is hydrolysed with 30 ml of water and the temperature raised to about 20° C. The mixture, is extracted with 3×20 ml of ethyl acetate. The product is separated on a silica column, using a pentane-ether mixture (50/50) as eluent. The yield is 85%.

EXAMPLE 1

General Procedure

To 40 ml of Solution (A) introduced into the electrolyser are added:

0.2 g ($6.10^{-4}$ mole) of tetrabutylammonium tetrafluoroborate $10^{-2}$ mole of the aromatic or heterocyclic halogen derivative $3\times10^{-4}$ mole of derivative (II) (i.e. 3% in moles with respect to the aromatic or heterocyclic halogen derivative.

The reaction is performed at ambient temperature (about 20° C.). An inert gas (argon) saturated with the vapour of the solvent mixture is bubbled through for about 10 minutes. The bubbling through the solution is then maintained throughout the electrolysis operation.

The electrolyser contains an anode comprising an aluminium bar (diameter 1 cm) in the centre of the reactor and a cylindrical nickel foam cathode (diameter 3 cm−height 5 cm) concentrically arranged around the anode.

The electrical intensity is maintained at a constant value of 0.25 amperes with a stabilized supply, until the complete disappearance of the aromatic or heterocyclic halogen derivative. The addition of the derivative (II) is performed by addition of 200 $\mu$l fractions of solution at 0 625 M/l in dimethylformamide every two minutes. After 3 hours, corresponding to the passage of 2.7 Faradays per mole of the aromatic or heterocyclic halogen derivative, the electrolysis and the addition of derivative (II) are stopped (total addition 12.5 millimole). The solution is hydrolysed with 40 ml of 1N hydrochloric acid. The solvents are removed under vacuum in a rotary evaporator. The residue is taken up in water. The aqueous phase is extracted 3 times with 40 ml of ethyl ether. The organic phase is separated by decantation, rinsed 5 times with 40 ml of distilled water, dried over magnesium sulfate, then filtered and evaporated to dryness under reduced pressure. The expected product is purified by chromatography on 100 g of silica in a 3 cm diameter column (eluent generally pentane/ether: 50/50).

The diastereoisomeric excess is determined by gas-phase chromatography.

EXAMPLE 2

Example of Hydrolysis in Alkaline Medium to Obtain the Corresponding Acid 0.5 g of the product obtained according to example 1 are dissolved in 5 ml of tetrahydrofuran, then 0.003 g of lithium hydroxide monohydrate are added. The mixture is left to react for 18 to 20 hours at a temperature of about 20° C. 20 ml of water are added and the whole extracted twice with 20 ml of dichloromethane. The aqueous phase is acidified, then extracted twice with 20 ml of dichloromethane. The organic phases are dried over magnesium sulfate, then evaporated. The pure acid is thus obtained. The rotatory power is measured and compared with the literature value to give the enantiomeric excess.

EXAMPLE 3

Example of Hydrolysis in Acid Medium to Obtain The Corresponding Acid 0.5 of the product obtained according to example 1 are added to 5 ml of 8N aqueous sulfuric acid. This is brought to reflux and left to react for 18 to 20 hours at a temperature of about 100° C. It is neutralized with 5% soda and then extracted twice with 20 ml of dichloromethane. The aqueous phase is acidified, then extracted twice with 20 ml of dichloromethane. The organic phases are dried over magnesium sulfate, then evaporated. The pure acid is thus obtained. The rotatory power is measured and compared with the literature value to give the enantiomeric excess.

EXAMPLE 4

Example of Transesterification to Obtain the Methyl Ester 2 g of the product obtained from example 1 are added to 20 ml of methanol, then 0.1 g of potassium carbonate are added. This is left to react for from a few minutes to 6 hours, until complete conversion. The solution is hydrolysed with 20 ml of a aqueous solution of NaCl and extracted 3 times with 20 ml of ether. The organic phases are rinsed with an aqueous solution of NaCl, then dried over magnesium sulfate. After evaporation of the ether, the methyl ester is separated on a silica column with a pentane/ether mixture (95/5). Measurement of rotatory power and comparison with the literature value gives the enantiomeric excess.

Use of the general method described above gives the following results:

RESULTS ACCORDING TO EXAMPLE 1

| (II) $R_3$ | aromatic or heterocyclic halogen derivative | configuration of the product obtained | enantlomeric excess (diastereoisomeric) excess) | Yield |
|---|---|---|---|---|
| C | iodobenzene | R | 52% (de 63%) | 50% |
| A | iodobenzene | R | 90% (de 96%) | 57% |
| A | 3-trifluoromethyl-bromobenzene | R | 87% (de 92%) | 51% |
| B | 3-trifluoromethyl-bromobenzene | S | 80% (de 92%) | 51% |
| B | 2-methoxy-bromobenzene | S | (de 93%) | 57% |
| B | 3-bromoaniline | S | 79% (de 95%) | 54% |

-continued

| (II) $R_3$ | aromatic or heterocyclic halogen derivative | configuration of the product obtained | enantiomeric excess (diastereoisomeric) excess) | Yield |
|---|---|---|---|---|
| B | 3-bromothiophene | S | (de 92%) | 30% |
| B | 3-bromopyridine | S | (de 93%) | 45% |
| B | 6-methoxy-2 bromonaphthalene | S | 85% (de 93%) | 62% |
| B | 4-phenyl-3-fluoro-bromobenzene | S | 82% (de 92%) | 58% |
| B | 3-acetyl-bromobenzene | S | (de 91%) | 61% |
| B | 3-trifluoromethyl-chlorobenzene | S | (de 91%) | 52% |

Proceeding as in examples 2 or 3 gives the acids corresponding to the products obtained above.

Proceeding as in example 4 gives the methyl esters corresponding to the products obtained above.

What is claimed is:

1. Method for preparing chiral 2-aryl or 2-heterocyclyl propionic acids and their esters characterized in that a mixture of a propionic acid derivative with formula

II

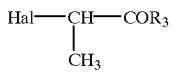

in which $R_3$ represents a radical of formula:

A

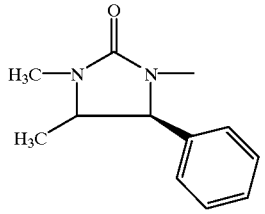

or

B

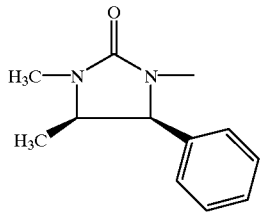

or

C

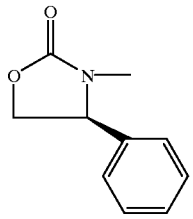

and Hal represents a halogen atom, or $R_3$ represents an aromatic or heterocyclic halogen derivative is electrochemically reduced in the presence of a nickel complex as a catalyst and a supporting electrolyte in an electrolysis cell provided with electrodes, in an organic solvent medium, then either the product is hydrolyzed to obtain the chiral-2-aryl or 2-heterocyclyl propionic acid or transesterified to obtain the corresponding ester.

2. Method according to claim 1 wherein the halogen atom in the derivative of formula (II) is a chlorine atom.

3. Method according to claim 1 wherein the halogen of the aromatic or heterocyclic halogen derivative is an iodine, bromine or chlorine atom.

4. Method according to claim 1 for preparing compounds of formula:

(I)

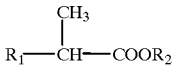

in which $R_1$ is optionally substituted aryl or heterocyclic and $R_2$ is hydrogen or an alkyl radical or a phenylalkyl whose alkyl portion contains 1 to 6 carbon atoms in a straight or branched chain.

5. Method according to claim 4 for preparing compounds of formula (I) wherein $R_1$ is (a) a phenyl radical, (b) a phenyl radical substituted by one or more substituents selected from chlorine, bromine, fluorine, alkyl, alkoxy, alkenyl, hydroxy, hydroxyalkyl, acyl, benzoyl, amino, phenyl, chlorophenyl, bromophenyl, fluorophenyl, phenoxy, cyano, polyfluoroalkyl, polyfluoroalkoxy, alkoxycarbonyl, —CH($NH_2$)—COOH, saturated or unsaturated heterocycle with 5 to 14 members and containing a heteroatom selected from nitrogen, oxygen or sulfur optionally substituted by chlorine, bromine, fluorine, alkyl, phenyl, chlorophenyl, bromophenyl, fluorophenyl, (c) a naphthyl radical, (d) a naphthyl radical substituted by one or more substituents selected from chlorine, bromine, fluorine, alkyl, alkoxy, alkenyl, hydroxy, hydroxyalkyl, acyl, benzoyl, amino, phenyl, chlorophenyl, bromophenyl, fluorophenyl, phenoxy, cyano, polyfluoroalkyl, polyfluoroalkoxy, alkoxycarbonyl, saturated or unsaturated heterocycle with 5 to 14 members and containing one or more heteroatoms selected from nitrogen, oxygen or sulfur optionally substituted by chlorine, bromine, fluorine, alkyl, phenyl, chlorophenyl, bromophenyl, fluorophenyl, (e) a 9H-fluorenyl radical, (f) an anthracenyl radical, (g) a phenanthrenyl radical, (h) a saturated or unsaturated heterocycle with 5 to 14 members and containing one or more heteroatoms selected from nitrogen, oxygen or sulfur, or (i) a saturated or unsaturated heterocycle with 5 to 14 members and containing one or more heteroatoms selected from nitrogen, oxygen or sulfur and substituted by one or more substituents selected from chlorine, bromine, fluorine, alkyl, alkoxy, acyl, benzoyl, amino, phenyl, chlorophenyl, bromophenyl, fluorophenyl, phenoxy, cyano, polyfluoroalkyl, polyfluoroalkoxy, alkoxycarbonyl, saturated or unsaturated heterocycle with 5 to 14 members and containing one or more heteroatoms selected from nitrogen, oxygen or sulfur optionally substituted by chlorine, bromine, fluorine, alkyl, phenyl, chlorophenyl, bromophenyl, fluorophenyl, and $R_2$ represents a hydrogen atom or an alkyl or phenylalkyl radical, the alkyl, alkoxy and alkenyl radicals containing 1 to 6 carbon atoms in straight or branched chains, and the acyl radicals containing 2 to 6 carbon atoms.

6. Method according to claim 4 for preparing compounds of formula (I) wherein $R_2$ represents a hydrogen atom or a methyl, ethyl, propyl, isopropyl, butyl, tert-butyl or benzyl radical.

7. Method according to claim 6 wherein the transesterification to obtain the alkyl or phenylalkyl ester is carried out using potassium carbonate and an aliphatic alcohol of 1 to 6 carbon atoms or an alcohol Ar-alkOH in which Ar is phenyl and alk is alkyl of 1 to 6 carbon atoms at a temperature of about 20° C.

8. Method according to claim 4 for preparing compounds of formula (I) wherein $R_1$ represents or contains a heterocycle with 5 to 14 members, this being selected from carbazole, indan, thiophene, furan, 1-isoindolinone, pyrrole, 2,5-dihydropyrrole, benzoxazole, 5H[1]benzopyrano[2,3-b] pyridine, pyridine, imidazole, oxazole, quinoline, isoquinoline, pyrimidine, phenothiazine, phenoxazine, a piperazine.

9. Method according to claim 4 for preparing compounds of formula (I) wherein $R_1$ represents a 2-aminophenyl, 3-benzyoylphenyl, 3-aminophenyl, 4-aminophenyl, 4-isobutylphenyl, 6-methoxy-2-naphthyl, 5-benzoyl-2-thienyl, 3-phenoxyphenyl, 2-fluoro-4-biphenyl, 3-fluoro-4-biphenyl, 1-oxo-2-isoindolinyl, 3-chloro-4-(2,5-dihydro-1H-pyrrol-1-yl)phenyl, 4-(2-thienylcarbonyl)phenyl, 9H-fluoren-2-yl, 6-chloro-9H-carbazol-3-yl, 2-(4-chlorophenyl)benzoxazol-5-yl, 4-cyclohexylphenyl, pyridin-2-yl, 5H-[1]benzopyrano[2,3-b]pyridin-7-yl, 3-trifluoromethoxyphenyl or 3-acetylphenyl radical.

10. Method according to claim 1 wherein the derivative of formula (II) and the aromatic or heterocyclic halogen derivative are reacted together in stoichiometric amounts.

11. Method according to claim 1 wherein the derivative of formula (II) is added progressively during the electrolysis.

12. Method according to claim 1 wherein the nickel complex is a complex with a nitrogen-containing ligand.

13. Method according to claim 12 wherein the nickel complex with a nitrogen-containing ligand is a $NiBr_2$bipyridine or nickel-orthophenanthroline complex.

14. Method according to of claim 1 wherein the quantity of the nickel complex is between 0.01 mole and 0.2 mole for 1 mole of the aromatic or heterocyclic halogen derivatives.

15. Method according to claim 14 wherein the quantity of the nickel complex is 0.1 mole for 1 mole of the aromatic or heterocyclic halogen derivative.

16. Method according to claim 1 wherein the electrolyte is a quaternary ammonium salt or an inorganic salt.

17. Method according to claim 16 wherein the electrolyte is a quaternary, ammonium salt or an inorganic salt selected from tetrabutylammonium tetrafluoroborate, tetrabutylammonium bromide or sodium bromide.

18. Method according to one claim 1 wherein the concentration of the electrolyte is between $5.10^{-3}$ M and $2.10^{-2}$ M.

19. Method according to claim 18 wherein the concentration of the electrolyte is $1.5.10^{-2}$ M.

20. Method according to claim 19 wherein the solvent medium is dimethylformamide, N-methylpyrrolidone or a dimethylformamide-ethanol mixture in a ratio from 80–20% to 20–80%.

21. Method according to claim 1 wherein the solvent medium is an aprotic solvent or a mixture of aprotic and protic solvents.

22. Method according to claim 1 wherein the anode is a consumable anode of aluminium, an aluminium alloy, zinc, iron or magnesium.

23. Method according to claim 1 wherein the cathode is of stainless steel, copper, nickel or carbon fibres.

24. Method according to claim 23 wherein the cathode has a hollow cylindrical shape and is arranged concentrically around the anode.

25. Method according to claim 1 wherein the temperature of the solvent medium is between 15° C. and 100° C.

26. Method according to claim 1 wherein the electrolysis is carried out at a constant intensity of between 0.1 and 1 Ampere.

27. Method according to claim 26 wherein the electrolysis is carried out at a current density which is from 0.5 to 1 $A/dm^2$ with respect to the cathode surface area.

28. Method according to claim 1 wherein the quantity of electricity necessary is between 2 and 3 Faradays per mole of aromatic or heterocyclic halogen derivative.

29. Method according to claim 28 wherein the quantity of electricity is 2.5 Faradays per mole of aromatic or heterocyclic halogen derivative.

30. Method according to claim 1 wherein the electrolytic reduction is carried out in an electrolysis cell without a separate compartment containing the solvent in which is added the supporting electrolyte, the aromatic or heterocyclic halogen derivative, the nickel catalyst, part of the derivative of formula (II), and the remainder of the derivative (II) being added in small portions during the electrolysis, and the electrolysis cell comprises a consumable anode, a cathode, a stirring system, an inlet for inert gas, a temperature regulation system and a stabilized electrical supply.

31. Method according to claim 30 wherein the aromatic or heterocyclic halogen derivative is used at a concentration of between 0.01 M/l and 1 M/l, the nickel catalyst at a concentration of 10% in moles with respect to the initial aromatic or heterocyclic halogen derivative and the derivative of formula (II) at a concentration of 3% in moles with respect to the initial aromatic or heterocyclic halogen derivative, the remainder the derivative of formula (II) being added in small portions during the electrolysis.

32. Method according to claim 1 wherein said method is carried out in a tubular circulating electrolysis cell comprising a central rod of aluminum or an Al/Cu/Mg alloy as anode and a stainless steel tube as cathode.

33. Method according to claim 1 wherein the hydrolysis of the product obtained after extraction, to obtain the propionic acid, is performed in acid medium.

34. Method according to claim 33 wherein the hydrolysis is carried out by means of 6N aqueous sulfuric acid, under reflux.

35. Method according to claim 1 wherein said method comprises an extraction step and wherein the hydrolysis of the product obtained after extraction, to obtain the chiral-2-aryl or 2-heterocyclyl propionic acid is carried out in basic medium.

36. Method according to claim 35 wherein the hydrolysis is carried out by means of lithium hydroxide, in tetrahydrofuran, at a temperature of about 20° C.

* * * * *